US011434885B2

(12) United States Patent
Hayama et al.

(10) Patent No.: US 11,434,885 B2
(45) Date of Patent: Sep. 6, 2022

(54) CAPACITY CONTROL VALVE AND METHOD FOR CONTROLLING SAME

(71) Applicant: EAGLE INDUSTRY CO., LTD., Tokyo (JP)

(72) Inventors: Masahiro Hayama, Tokyo (JP); Yoshihiro Ogawa, Tokyo (JP); Keigo Shirafuji, Tokyo (JP); Kohei Fukudome, Tokyo (JP); Takahiro Ejima, Tokyo (JP); Daichi Kurihara, Tokyo (JP); Wataru Takahashi, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 16/957,340

(22) PCT Filed: Dec. 26, 2018

(86) PCT No.: PCT/JP2018/047693

§ 371 (c)(1),
(2) Date: Jun. 23, 2020

(87) PCT Pub. No.: WO2019/131693

PCT Pub. Date: Jul. 4, 2019

(65) Prior Publication Data

US 2020/0332786 A1 Oct. 22, 2020

(30) Foreign Application Priority Data

Dec. 27, 2017 (JP) ..... JP2017-252351

(51) Int. Cl.
*F04B 27/18* (2006.01)

(52) U.S. Cl.
CPC .... *F04B 27/1804* (2013.01); *F04B 2027/185* (2013.01); *F04B 2027/1813* (2013.01);
(Continued)

(58) Field of Classification Search
CPC ..... F04B 27/1804; F04B 2027/1813; F04B 2027/1827; F04B 2027/1831;
(Continued)

(56) References Cited

U.S. PATENT DOCUMENTS 1,614,002 A * 1/1927 Horton ..... A62C 35/605 137/72
2,267,515 A 12/1941 Wilcox ..... F16K 31/0627
(Continued)

FOREIGN PATENT DOCUMENTS

CN 111316028 6/2020 ..... F16K 31/06
CN 111417780 7/2020 ..... F04B 27/18
(Continued)

OTHER PUBLICATIONS

International Search Report (ISR) dated Mar. 19, 2019, issued for International application No. PCT/JP2018/047693. (1 page).
(Continued)

*Primary Examiner* — Devon C Kramer
*Assistant Examiner* — Joseph S. Herrmann
(74) *Attorney, Agent, or Firm* — Hayes Soloway P.C.

(57) ABSTRACT

A capacity control valve (1) includes a valve main body (10) having a first communication passage (11), a second communication passage (12), a third communication passage (13), and a main valve seat (15*a*), a valve element (20) having an intermediate communication passage (29), a main valve portion (21*c*), and an auxiliary valve portion (23*d*), a solenoid (30) that drives a rod (36) having an auxiliary valve seat (26*c*), and a first biasing member (43) that biases in the valve closing direction of the main valve portion (21*c*). A spring constant of the first biasing member (43) has a characteristic that the spring constant is increased in an opened state of the main valve portion (21*c*) and decreased in a closed state. The capacity control valve can efficiently
(Continued)

discharge a liquid coolant and lower drive force of a compressor at a liquid coolant discharging operation.

5 Claims, 7 Drawing Sheets

(52) U.S. Cl.
CPC ..... *F04B 2027/1827* (2013.01); *F04B 2027/1831* (2013.01); *F04B 2027/1845* (2013.01); *F04B 2027/1859* (2013.01); *F04B 2027/1868* (2013.01); *F04B 2027/1881* (2013.01)

(58) Field of Classification Search
CPC ..... F04B 2027/1845; F04B 2027/185; F04B 2027/1859; F04B 2027/1868; F04B 2027/1881; F04B 27/1877; F04B 27/1854; F16K 11/161; F16K 31/06; F16K 31/0624; F16F 1/32; F16F 1/324; F16F 2228/12
USPC ..... 267/159, 161, 163; 251/337
See application file for complete search history.

(56) References Cited

U.S. PATENT DOCUMENTS 3,360,304 A 12/1967 Adams ..... B61K 7/12
3,483,888 A * 12/1969 Wurzel ..... F16K 15/046 137/539
4,364,615 A * 12/1982 Euler ..... F16C 27/04 267/159
4,579,145 A 4/1986 Leiber ..... F16H 61/0251
4,615,358 A 10/1986 Hammond ..... F15B 13/0402
4,895,192 A 1/1990 Mortenson ..... F01M 11/04
4,917,150 A 4/1990 Koch ..... F16K 31/0606
4,979,542 A 12/1990 Mesenich ..... F02M 47/027
4,998,559 A 3/1991 McAuliffe ..... F16H 61/0251
5,060,695 A 10/1991 McCabe ..... G05D 16/2024
5,217,047 A 6/1993 McCabe ..... F16H 16/0251
5,263,694 A * 11/1993 Smith ..... B60G 15/068 267/162
5,778,932 A 7/1998 Alexander ..... G05D 16/2024
6,161,585 A 12/2000 Kolchinsky ..... F05D 16/2024
6,481,976 B2 11/2002 Kimura ..... F04B 27/1804
8,021,124 B2 * 9/2011 Umemura ..... F04B 27/1804 417/222.2
8,079,827 B2 12/2011 Iwa ..... F04B 27/1804
8,225,818 B1 7/2012 Stephens ..... F15B 13/0442
8,651,826 B2 2/2014 Futakuchi ..... F04B 27/1804
9,022,346 B2 5/2015 Najmolhoda ..... F16K 31/0613
9,027,598 B2 5/2015 Schneider ..... F16K 31/0613
9,132,714 B2 9/2015 Futakuchi ..... F04B 27/1804
9,297,373 B2 * 3/2016 Bagagli ..... F16K 15/026
9,400,027 B2 * 7/2016 Imaizumi ..... F16F 1/32
9,453,518 B2 9/2016 Schulz ..... F15B 13/043
9,581,149 B2 2/2017 Ota et al. ..... F04B 27/1804
9,581,150 B2 2/2017 Ota et al. ..... F04B 27/1804
9,732,874 B2 * 8/2017 Saeki ..... F16K 31/0603
9,874,286 B2 * 1/2018 Bagagli ..... F16K 15/12
10,111,539 B2 10/2018 Sugamura ..... F04B 27/1804
10,519,944 B2 12/2019 Taguchi ..... F04B 27/1804
10,557,463 B2 2/2020 Sugamura ..... F04B 27/1804
10,837,431 B2 11/2020 Tonegawa
2001/0003573 A1 6/2001 Kimura et al. ..... 417/222.2
2002/0134444 A1 9/2002 Isobe ..... F16K 27/041
2003/0145615 A1 8/2003 Sasaki ..... F16K 31/0637
2003/0202885 A1 10/2003 Taguchi ..... F04B 49/00
2004/0045305 A1 3/2004 Murase ..... F25B 49/022
2004/0165994 A1 8/2004 Umemura ..... F04B 27/1804
2005/0076959 A1 4/2005 Yamamoto ..... F16K 31/0624
2005/0151310 A1 * 7/2005 Rodeffer ..... F16F 1/32 267/161
2007/0214814 A1 9/2007 Umemura et al.
2007/0264134 A1 11/2007 Hirota ..... F04B 27/1804
2008/0138213 A1 6/2008 Umemura et al. ..... 417/222.2
2008/0175727 A1 7/2008 Umemura et al. ..... F04B 49/22
2009/0108221 A1 4/2009 Umemura et al. ..... 251/129.15
2009/0114871 A1 5/2009 Iwa ..... F04B 27/14
2009/0183786 A1 7/2009 Iwa ..... F04B 27/1804
2009/0256091 A1 10/2009 Nordstrom ..... F16K 31/0613
2010/0282991 A1 11/2010 Okamoto ..... F16K 31/02
2011/0089352 A1 4/2011 Morgan ..... F16K 11/0716
2012/0198992 A1 8/2012 Futakuchi et al. ..... 91/505
2012/0198993 A1 8/2012 Fukudome ..... 91/505
2013/0291963 A1 11/2013 Futakuchi et al. ..... 137/487.5
2014/0099214 A1 4/2014 Fukudome ..... 417/222.2
2014/0130916 A1 * 5/2014 Saeki ..... F16K 31/0613 137/625.48
2014/0294632 A1 10/2014 Kondo et al. ..... 417/434
2014/0369862 A1 12/2014 Ota et al. ..... F04B 27/1804
2015/0021131 A1 * 1/2015 Wootten ..... F16F 9/348 188/280
2015/0027573 A1 1/2015 Ochiai ..... F15B 13/0402
2015/0044067 A1 2/2015 Ota et al. ..... F04B 27/1804
2015/0068628 A1 3/2015 Iwa ..... 137/625.65
2015/0104334 A1 4/2015 Ota et al. ..... F04B 27/1804
2015/0345655 A1 * 12/2015 Higashidozono ... F04B 27/1804 137/624.27
2016/0290326 A1 * 10/2016 Sugamura ..... F04B 27/1804
2017/0284562 A1 10/2017 Hayama ..... F16K 41/00
2018/0156345 A1 6/2018 Kanda ..... F15B 13/0431
2018/0187793 A1 7/2018 Futakuchi ..... F04B 39/08
2018/0291888 A1 10/2018 Tonegawa et al. ..... F04B 49/22
2020/0309105 A1 10/2020 Hayama et al. ..... F04B 27/18
2020/0318624 A1 * 10/2020 Hayama ..... F04B 27/18
2020/0332786 A1 10/2020 Hayama ..... F04B 27/1804
2020/0362974 A1 11/2020 Hayama et al. ..... F16K 11/24

FOREIGN PATENT DOCUMENTS

EP 2594794 5/2013 ..... F04B 27/18
EP 3726054 10/2020 ..... F04B 27/18
JP 6-26454 2/1994 ..... F04B 27/08
JP 2001165055 6/2001 ..... F04B 27/14
JP 2004003468 1/2004 ..... F04B 27/14
JP 2005307817 11/2005 ..... F04B 27/14
JP 2005307817 A 11/2005
JP 2007247512 9/2007 ..... F04B 27/14
JP 2008157031 7/2008 ..... F04B 27/14
JP 2009275550 11/2009 ..... F04B 49/00
JP 2012211579 11/2012 ..... F04B 27/14
JP 5167121 B2 3/2013
JP 2014080927 5/2014 ..... F04B 27/16
JP 2014080927 A 5/2014
JP 2014092207 5/2014 ..... F16K 31/06
JP 2014095463 5/2014 ..... F16K 31/06
JP 2014095463 A 5/2014
JP 2014194180 10/2014 ..... F04B 27/14
JP 201575054 4/2015 ..... F04B 27/14
JP 20151168 5/2015 ..... F04B 27/14
JP 2015137546 7/2015 ..... F04B 27/14
JP 2015178795 10/2015 ..... F04B 27/14
JP 5983539 8/2016 ..... F04B 27/18
JP 2016196825 11/2016 ..... F04B 27/18
JP 2016196876 11/2016 ..... F04B 27/18
JP 2016205404 12/2016 ..... F04B 27/18
JP 6135521 5/2017 ..... F04B 27/18
JP 2017089832 5/2017 ..... F16K 31/06
JP 2018179087 11/2018 ..... F16K 31/06
WO WO2006090760 8/2006 ..... F04B 27/18
WO WO2009025298 2/2009 ..... F16K 31/06
WO WO2011114841 9/2011 ..... F04B 27/14
WO WO2012077439 6/2012 ..... F04B 27/14
WO WO2014119594 8/2014 ..... F04B 27/14

OTHER PUBLICATIONS

International Search Report and Written Opinion with translation issued in PCT/JP2019/001570, dated Jul. 25, 2019 (19 pages).

(56) References Cited

OTHER PUBLICATIONS

International Preliminary Report on Patentability with translation issued in PCT/JP2019/001570, dated Jul. 28, 2020 (6 pages).
International Search Report and Written Opinion with translation issued in PCT/JP2018/043652, dated Feb. 19, 2019 (21 pages).
International Preliminary Report on Patentability with translation issued in PCT/JP2018/043652, dated Jun. 2, 2020 (7 pages).
International Search Report and Written Opinion with translation issued in PCT/JP2018/045782, dated. Feb. 26, 2019 (11 pages).
International Preliminary Report on Patentability with translation issued in PCT/JP2018/045782, dated Jun. 16, 2020 (4 pages).
Official Action issued in related U.S. Appl. No. 16/961,627, dated Oct. 26, 2021 (24 pgs).
Official Action issued in related U.S. Appl. No. 16/766,124, dated Oct. 27, 2021 (11 pgs).
Notice of Allowance issued in related U.S. Appl. No. 16/766,124, dated Apr. 4, 2022 (5 pgs).
Official Action issued in related U.S. Appl. No. 16/957,344, dated Mar. 29, 2022 (19 pgs).
European Official Action issued in related European Patent Application Serial No. 18897846.4, dated Apr. 14, 2022 (5 pgs).
Korean Official Action issued in related Korean Patent Application Serial No. 10-2020-7013914, dated Mar. 15, 2022 (5 pgs).
Chinese Office Action issued in Chinese Patent Appln. Serial No. 201880080867.9, dated. Mar. 16, 2022, with English translation, 13 pages.
Japanese Office Action issued in Japanese Patent Appln. Serial No. 2019-562060, dated May 10, 2022, with English translation, 8 pages.
Japanese Office Action issued in Japanese Patent Appln. Serial No. 2019-562061, dated May 10, 2022 with English translation, 10 pages.
U.S. Appl. No. 16/480,281, filed Jul. 23, 2019, Higashidozono et al.
U.S. Appl. No. 16/483,621, filed Aug. 5, 2019, Higashidozono et al.
U.S. Appl. No. 16/763,800, filed May 13, 2020, Hayama et al.
U.S. Appl. No. 16/766,096, filed May 21, 2020, Kurihara et al.
U.S. Appl. No. 16/957,344, filed Jun. 23, 2020, Hayama et al.
U.S. Appl. No. 16/961,620, filed Jul. 10, 2020, Hayama et al.
U.S. Appl. No. 17/293,435, filed May 12, 2021, Hayama et al.
U.S. Appl. No. 16/772,703, filed Jun. 12, 2020, Hayama et al.
U.S. Appl. No. 14/431,270, filed Mar. 25, 2015, Higashidozono et al.
The First Office Action issued in Chinese Patent Appln. Serial No. 201880081296.0, dated Jul. 5, 2021, with English translation, 9 pages.
Extended European Search Report issued in European Patent Appln. Serial No. 18896700.4, dated Aug. 12, 2021, 8 pages.
European Official Action issued in related European Patent Application Serial No. 18885296.6, dated Jan. 21, 2022, 4 pages.
International Preliminary Report on Patentability issued in PCT/JP2018/047716, dated Jun. 30, 2020, 8 pages.
International Search Report and Written Opinion issued in PCT/JP2018/047716, dated Mar. 26, 2019, with English translation, 14 pages.
International Preiminary Report on Patentability issued in PCT/JP2014/051901, dated Aug. 13, 2015, 7 pages.
International Search Report issued in PCT/JP2014/051901, dated Apr. 18, 2014, 4 pages.
International Preliminary Report on Patentability International Search Report and Written Opinion issued in PCT/JP2019/045731, dated Feb. 4, 2020, 21 pages.
International Search Report issued in PCT/JP2018/004500, dated May 15, 2018, 12 pages.
International Preliminary Report on Patentability issued in PCT/JP2018/004500, dated Aug. 20, 2019, 4pages.
International Search Report issued in PCT/JP2018/041768, dated Jan. 22, 2019, 16 pages.
International Preliminary Report on Patentability issued in PCT/JP2018/041768, dated May 19, 2020, 6 pages.
International Search Report issued in PCT/JP2018/002084, dated Apr. 17, 2018, 11 pages.
International Preliminary Report on Patentability issued in PCT/JP2018/002084, dated Jul. 30, 2019, 4 pages.
International Search Report issued in PCT/JP2018/047693, dated Mar. 19, 2019, 11 pages.
International Preliminary Report on Patentability issued in PCT/JP2018/047693, dated Jun. 30, 2020, 4 pages.
International Search Report issued in PCT/JP2018/047694, dated Mar. 19, 2019, 20 pages.
International Preliminary Report on Patentability issued in PCT/JP2018/047694, dated Jun. 30, 2020, 7 pages.
International Search Report issued in PCT/JP2018/045010, dated Feb. 26, 2019, 11 pages.
International Preliminary Report on Patentability issued m PCT/JP2018/045010, dated. Jun. 9, 2020, 4 pages.
International Search Report issued in PCT/JP2019/001569, dated Apr. 16, 2019, 20 pages.
International Preliminary Report on Patentability issued PCT/JP2019/001569, dated Oct. 15, 2018, 7pages.
Notice of Allowance issued in related U.S. Appl. No. 16/961,620, dated Feb. 9, 2022 (6 pgs).
Notice of Allowance issued in related U.S. Appl. No. 16/772,703, dated Oct. 13, 2021 (5 pgs).
Official Action Issued in related U.S. Appl. No. 16/961,620, dated Aug. 5, 2021 (7 pgs).
Official Action issued in related U.S. Appl. No. 17/293,435, dated Nov. 23, 2021 (12 pgs).
Official Action issued in related U.S. Appl. No. 16/957,344, dated Mar. 29, 2022 (12 pgs).
Korean Official Action issued in related Korean Application Serial No. 10-2020-7013914, dated Mar. 15, 2022, with translation (5 pgs).
European Official Action issued in related European Application Serial No. 18897846.4, dated Apr. 14, 2021 (5 pgs).

* cited by examiner

CAPACITY CONTROL VALVE AND METHOD FOR CONTROLLING SAME

CROSS-REFERENCE TO RELATED APPLICATIONS

This application is the U.S. National Phase under 35 U.S.C. § 371 of International Application PCT/JP2018/047693, filed Dec. 26, 2018, which claims priority to Japanese Patent Application No. JP2017-252351, filed Dec. 27, 2017. The International Application was published under PCT Article 21(2) in a language other than English.

TECHNICAL FIELD

The present invention relates to a capacity control valve and a method for controlling the capacity control valve used for controlling a flow rate or pressure of a variable capacity compressor.

BACKGROUND ART

As the variable capacity compressor, for example, a swash plate type capacity variable compressor used in an air conditioning system of an automobile, etc. includes a rotation shaft to be driven and rotated by rotation force of an engine, a swash plate coupled to the rotation shaft so that a tilting angle is variable, and compressing pistons coupled to the swash plate, etc., and is to change strokes of the pistons and control a discharge amount of a coolant by changing the tilting angle of the swash plate.

This tilting angle of the swash plate can be continuously changed by appropriately controlling pressure in a control chamber by using a capacity control valve to be driven and opened/closed by electromagnetic force while utilizing suction pressure of a suction chamber to which the coolant is sucked in, discharge pressure of a discharge chamber from which the coolant pressurized by the pistons is discharged, and control chamber pressure of the control chamber (crank chamber) in which the swash plate is housed, and by adjusting a balance state of pressure acting on both surfaces of the pistons.

FIG. 6 shows an example of such a capacity control valve. A capacity control valve 160 includes a valve portion 170 having a second valve chamber 182 which communicates with the discharge chamber of the compressor via a second communication passage 173, a first valve chamber 183 which communicates with the suction chamber via a first communication passage 171, and a third valve chamber 184 which communicates with the control chamber via a third communication passage 174, a pressure-sensitive body 178 arranged in the third valve chamber, the pressure-sensitive body to be extended and contracted by peripheral pressure, the pressure-sensitive body having a valve seat body 180 provided in a free end in the extending and contracting direction, a valve element 181 having a second valve portion 176 which opens and closes a valve hole 177 providing communication between the second valve chamber 182 and the third valve chamber 184, a first valve portion 175 which opens and closes the first communication passage 171 and a distribution groove 172, and a third valve portion 179 which opens and closes the third valve chamber 184 and the distribution groove 172 by engagement with and disengagement from the valve seat body 180 in the third valve chamber 184, a solenoid portion 190 which applies electromagnetic drive force to the valve element 181, etc.

In this capacity control valve 160, without providing a clutch mechanism in the variable capacity compressor, in a case where the need for changing the control chamber pressure arises, the pressure (control chamber pressure) Pc in the control chamber and the suction pressure Ps (suction pressure) can be controlled by providing communication between the discharge chamber and the control chamber (hereinafter, referred to as the "conventional art". See Patent Document 1, for example).

CITATION LIST

Patent Documents

Patent Document 1: JP 5167121 B

SUMMARY OF THE INVENTION

Problem to be Solved by the Invention

In the conventional art, in a case where the swash plate type capacity variable compressor is stopped for a long time, a liquid coolant (made by cooling and liquefying a coolant during abandonment) is accumulated in the control chamber (crank chamber). Thus, even when the compressor is started up in this state, it is not possible to ensure a discharge amount as it is set. Therefore, in order to perform desired capacity control immediately after start-up, there is a need for discharging the liquid coolant of the control chamber (crank chamber) as soon as possible.

As shown in FIG. 7, the conventional capacity control valve 160 includes a function of discharging the liquid coolant in order to discharge the liquid coolant of the control chamber (crank chamber) as soon as possible at the time of start-up. That is, in a case where the capacity variable compressor is stopped and abandoned for a long time and then started up, the high-pressure liquid coolant accumulated in the control chamber (crank chamber) flows into the third valve chamber 184 from the third communication passage 174. Then, the pressure-sensitive body 178 is contracted, a part between the third valve portion 179 and the valve seat body 180 is opened, and from the third valve chamber 184 through the auxiliary communication passage 185, the communication passage 186, and the distribution groove 172, the liquid coolant is discharged to the discharge chamber from the control chamber (crank chamber) via the suction chamber and rapidly gasified, so that it is possible to make a cooling operation state for a short time.

However, in the above conventional art, at an initial stage of a liquid coolant discharging process, pressure of the control chamber is high and hence an opening degree of the third valve portion 179 is large. Thus, it is possible to efficiently discharge the liquid coolant. However, as discharge of the liquid coolant progresses and the pressure of the control chamber is lowered, the opening degree of the third valve portion is decreased. Thus, there is a problem that it takes time to discharge the liquid coolant.

Conventionally, at the time of a liquid coolant discharging operation, focus is placed only on how quickly the discharge of the liquid coolant is completed. Thus, control of reducing an engine load is not performed at the time of the liquid coolant discharging operation. However, when the liquid coolant discharging operation is performed with a high engine load, the engine load is further increased, and there is also a problem that energy efficiency of the entire automobile is lowered.

The present invention is achieved to solve the problems of the above conventional art, and an object of the present invention is to provide a capacity control valve and a method for controlling a capacity control valve, capable of, in the capacity control valve that controls a flow rate or pressure of a variable capacity compressor in accordance with a valve opening degree of a valve portion, stably controlling an opening degree of a main valve portion at the time of control, efficiently discharging a liquid coolant irrespective of pressure of a suction chamber, shifting to a cooling operation for a short time, and further lowering drive force of the compressor at a liquid coolant discharging operation.

Means for Solving Problem

In order to solve the foregoing problems, a capacity control valve according to a first aspect of the present invention is a capacity control valve that controls a flow rate or pressure of a variable capacity compressor in accordance with a valve opening degree of a valve portion, the capacity control valve being characterized by including a valve main body having a first communication passage through which a fluid of first pressure passes, a second communication passage arranged adjacent to the first communication passage, the second communication passage through which a fluid of second pressure passes, a third communication passage through which a fluid of third pressure passes, and a main valve seat arranged in a valve hole which provides communication between the second communication passage and the third communication passage, a solenoid that drives a rod having an auxiliary valve seat, a valve element having an intermediate communication passage providing communication between the first communication passage and the third communication passage, a main valve portion to be separated from and connected to the main valve seat so as to open and close the valve hole, and an auxiliary valve portion to be separated from and connected to the auxiliary valve seat so as to open and close the intermediate communication passage, and a first biasing member that biases in the valve closing direction of the main valve portion, characterized in that a spring constant of the first biasing member has a characteristic that the spring constant is increased in an opened state of the main valve portion and decreased in a closed state.

According to the first aspect, in the opened state of the main valve portion where a load acting on the first biasing member is decreased, the spring constant is increased and hence the first biasing member is hardly deformed. Therefore, the rod and the valve element are integrally displaced in a state where relative positions are maintained. Thus, the capacity control valve can stably control an opening degree of the main valve portion. In the closed state of the main valve portion where the load acting on the first biasing member is increased, the spring constant of the first biasing member is decreased. Thus, without excessively increasing an output of the solenoid, the rod can easily deform the first biasing member and forcibly open the auxiliary valve portion. Thereby, in liquid coolant discharge, it is possible to maintain an opening degree of the auxiliary valve portion in a fully opened state and efficiently discharge the liquid coolant irrespective of pressure of a suction chamber.

The capacity control valve according to a second aspect of the present invention is characterized in that the first biasing member is arranged between the rod and the valve element.

According to the second aspect, it is possible to transmit drive force of the solenoid in the valve closing direction of the main valve portion via the first biasing member arranged between the rod and the valve element and reliably close the main valve portion.

The capacity control valve according to a third aspect of the present invention is characterized in that the first biasing member has a communication portion communicating with the intermediate communication passage.

According to the third aspect, regarding a coolant flowing through the intermediate communication passage, by the communication passage, a flow of the coolant is not inhibited.

The capacity control valve according to a fourth aspect of the present invention is characterized in that the solenoid further includes a plunger connected to the rod, a core arranged between the plunger and the valve main body, an electromagnetic coil, and a second biasing member arranged between the plunger and the core.

According to the fourth aspect, by the second biasing member arranged between the plunger and the core, it is possible to reliably bias the valve element in the valve opening direction of the main valve portion.

The capacity control valve according to a fifth aspect of the present invention is characterized in that the first pressure is suction pressure of the variable capacity compressor, the second pressure is discharge pressure of the variable capacity compressor, and the third pressure is pressure of a crank chamber of the variable capacity compressor. The capacity control valve according to a sixth aspect of the present invention is characterized in that the first pressure is pressure of a crank chamber of the variable capacity compressor, the second pressure is discharge pressure of the variable capacity compressor, and the third pressure is suction pressure of the variable capacity compressor.

According to the fifth or sixth aspect, it is possible to respond to various variable capacity compressors.

In order to solve the foregoing problems, a method for controlling a capacity control valve according to a seventh aspect of the present invention is a method for controlling a capacity control valve, characterized by including the step of making the main valve portion from a closed state to an opened state when the auxiliary valve portion is in an opened state.

According to the seventh aspect, in a state where biasing force of the pressure-sensitive body does not act on the valve element at the time of the liquid coolant discharge, the main valve portion is opened and a flow rate from a discharge chamber to a control chamber is increased, so that it is possible to reduce the load of the compressor.

DESCRIPTION OF EMBODIMENTS

Hereinafter, with reference to the drawings, a mode for carrying out the present invention will be described illustratively based on an embodiment. However, the dimensions, materials, shapes, relative positions, etc. of constituent parts described in this embodiment are not limited only to themselves unless otherwise described particularly explicitly.

Figure 1:
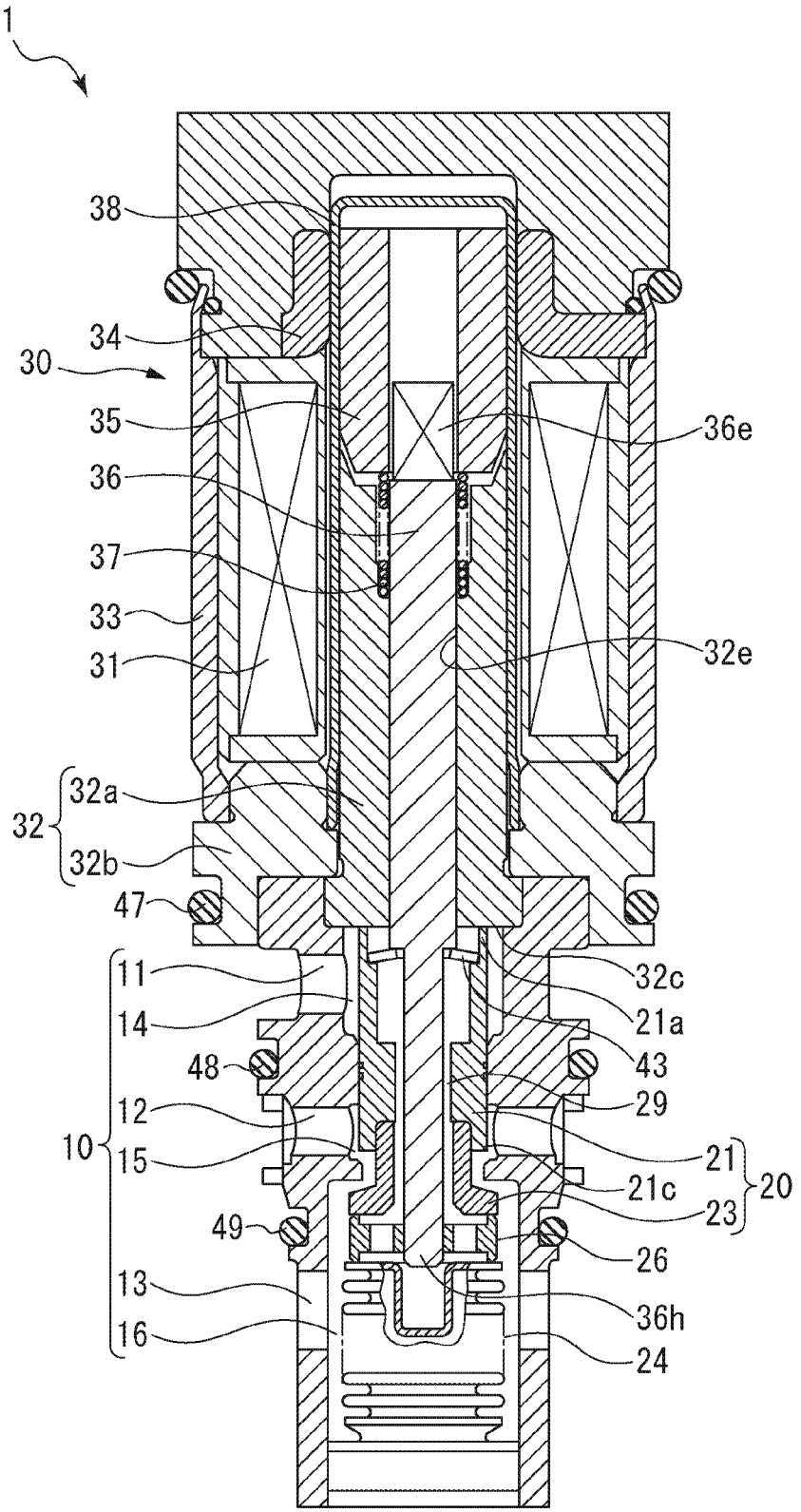
FIG. 1 is a front sectional view of a capacity control valve according to the present invention.

With reference to FIGS. 1 to 5, a capacity control valve according to the present invention will be described. In FIG. 1, the reference sign 1 denotes a capacity control valve. The capacity control valve 1 is mainly formed by a valve main body 10, a valve element 20, a pressure-sensitive body 24, and a solenoid 30.

Figure 2:
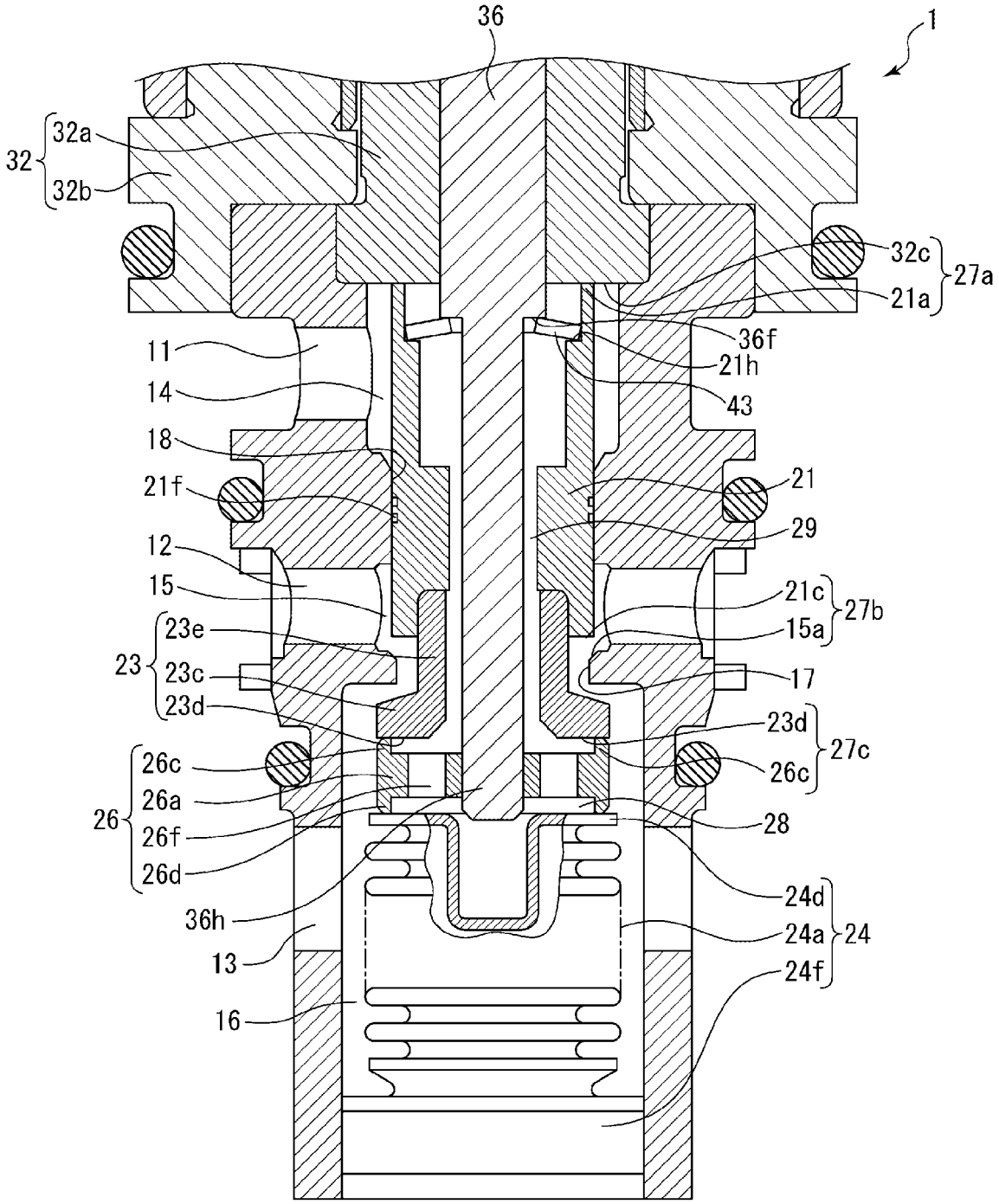
FIG. 2 is an enlarged view of part of a valve main body, a valve element, and a solenoid of FIG. 1 showing the capacity control valve at the time of turning off the solenoid.

Hereinafter, with reference to FIGS. 1 and 2, respective constituent elements of the capacity control valve 1 will be described. The valve main body 10 is made of metal such as brass, iron, aluminum, or stainless, or synthetic resin, etc. The valve main body 10 is a cylindrical hollow member having a through hole which passes through in the axial direction. In sections of the through hole, a first valve chamber 14, a second valve chamber 15 adjacent to the first valve chamber 14, and a third valve chamber 16 adjacent to the second valve chamber 15 are continuously arranged.

A second communication passage 12 is continuously provided in the second valve chamber 15. This second communication passage 12 communicates with the inside of a discharge chamber (not shown) of a variable capacity compressor so that a fluid of discharge pressure Pd (second pressure according to the present invention) can flow in from the second valve chamber 15 to the third valve chamber 16 by opening and closing the capacity control valve 1.

A third communication passage 13 is continuously provided in the third valve chamber 16. The third communication passage 13 communicates with a control chamber (not shown) of the variable capacity compressor so that the fluid of discharge pressure Pd flowing in from the second valve chamber 15 to the third valve chamber 16 by opening and closing the capacity control valve 1 flows out to the control chamber (crank chamber) of the variable capacity compressor and a fluid of control chamber pressure Pc (third pressure according to the present invention) flowing into the third valve chamber 16 flows out to a suction chamber of the variable capacity compressor via an intermediate communication passage 29 to be described later and through the first valve chamber 14.

Further, a first communication passage 11 is continuously provided in the first valve chamber 14. This first communication passage 11 leads a fluid of suction pressure Ps (first pressure according to the present invention) from the suction chamber of the variable capacity compressor to the pressure-sensitive body 24 via the intermediate communication passage 29 to be described later, and controls the suction pressure of the compressor to a set value.

Between the first valve chamber 14 and the second valve chamber 15, a hole portion 18 having a diameter smaller than a diameter of any of these chambers is continuously formed. A labyrinth 21*f* to be described later is formed in this hole portion 18, and forms a seal portion that seals a part between the first valve chamber 14 and the second valve chamber 15. Between the second valve chamber 15 and the third valve chamber 16, a valve hole 17 having a diameter smaller than a diameter of any of these chambers is continuously provided. A main valve seat 15*a* is formed around the valve hole 17 on the second valve chamber 15 side. This main valve seat 15*a* is separated from and connected to a main valve portion 21*c* to be described later so as to control opening and closing of a Pd-Pc flow passage providing communication between the second communication passage 12 and the third communication passage 13.

The pressure-sensitive body 24 is arranged in the third valve chamber 16. One end portion of a metal bellows 24*a* of this pressure-sensitive body 24 is combined to a partition adjusting portion 24*f* in a sealed state. This bellows 24*a* is made of phosphor bronze, stainless, etc. and a spring constant of the bellows is designed to be a predetermined value. An internal space of the pressure-sensitive body 24 is vacuum or the air exists in the internal space. Pressure acts on a valid pressure receiving area of the bellows 24*a* of this pressure-sensitive body 24 so that the pressure-sensitive body 24 is extended and contracted. A flange portion 24*d* is arranged on the free end portion side of the pressure-sensitive body 24. By directly pressing this flange portion 24*d* by a locking portion 26 of a rod 36 to be described later, the pressure-sensitive body 24 is extended and contracted. That is, as described later, the pressure-sensitive body 24 is extended and contracted in accordance with the suction pressure Ps led to the pressure-sensitive body 24 via the intermediate communication passage 29, and also extended and contracted by pressing force of the rod 36.

The partition adjusting portion 24*f* of the pressure-sensitive body 24 is sealed, fitted, and fixed so as to close the third valve chamber 16 of the valve main body 10. By screwing the partition adjusting portion 24*f* and fixing by a locking screw (not shown), it is possible to adjust axial movement of spring force of a compression spring arranged in parallel in the bellows 24*a* or the bellows 24*a*.

For example, two to six parts of each of the first communication passage 11, the second communication passage 12, and the third communication passage 13 pass through a peripheral surface of the valve main body 10 at equal intervals. Further, attachment grooves for O rings are provided at three points while being separated in the axial direction on an outer peripheral surface of the valve main body 10. O rings 47, 48, 49 that seal a part between the valve main body 10 and an installment hole of a casing (not shown) fitted to the valve main body 10 are attached to the attachment grooves. Flow passages of the first communication passage 11, the second communication passage 12, and the third communication passage 13 are formed as independent flow passages.

Next, the valve element 20 will be described. The valve element 20 is mainly formed by a main valve element 21 which is a cylindrical hollow member, and an adapter 23. First, the main valve element 21 will be described. The main valve element 21 is a cylindrical hollow member, and the labyrinth 21*f* is formed in a substantially center portion in the axial direction of an outer peripheral portion of the main valve element. The main valve element 21 is inserted into the valve main body 10, and the labyrinth 21*f* slides on the hole portion 18 between the first valve chamber 14 side and the second valve chamber 15 side so as to form a seal portion that seals the first valve chamber 14 and the second valve chamber 15. Thereby, the first valve chamber 14 communicating with the first communication passage 11 and the second valve chamber 15 communicating with the second communication passage 12 are formed as independent valve chambers.

The main valve element 21 is arranged on the first communication passage 11 side and on the second communication passage 12 side across the labyrinth 21*f*. The main valve portion 21*c* is formed in an end portion of the main valve element 21 arranged on the second communication passage 12 side. The main valve portion 21*c* is separated from and connected to the main valve seat 15*a* so as to control opening and closing of the valve hole 17 providing communication between the second valve chamber 15 and the third valve chamber 16. The main valve portion 21*c* and the main valve seat 15*a* form a main valve 27*b*. A situation where the main valve portion 21*c* and the main valve seat 15*a* are brought from a contact state into a separate state will be indicated as the main valve 27*b* is opened or the main valve portion 21*c* is opened. A situation where the main valve portion 21*c* and the main valve seat 15*a* are brought from a separate state into a contact state will be indicated as the main valve 27*b* is closed or the main valve portion 21*c* is closed. A shut-off valve portion 21*a* is formed in an end portion of the main valve element 21 arranged in the first valve chamber 14. The shut-off valve portion 21*a* is brought into contact with an end portion 32*c* of a core 32 when the solenoid 30 to be described later is turned off, so as to shut off communication between the intermediate communication passage 29 and the first valve chamber 14. The shut-off valve portion 21*a* and the end portion 32*c* of the core 32 form a shut-off valve 27*a*. The shut-off valve portion 21*a* and the main valve portion 21*c* of the valve element 20 are formed to perform opening and closing actions in the opposite directions to each other. A situation where the shut-off valve portion 21*a* and the end portion 32*c* of the core 32 are brought from a contact state into a separate state will be indicated as the shut-off valve 27*a* is opened or the shut-off valve portion 21*a* is opened. A situation where the shut-off valve portion 21*a* and the end portion 32*c* of the core 32 are brought from a separate state into a contact state will be indicated as the shut-off valve 27*a* is closed or the shut-off valve portion 21*a* is closed.

Next, the adapter 23 forming the valve element 20 will be described. The adapter 23 is mainly formed by a large diameter portion 23*c* formed to have a large diameter by a cylindrical hollow member, and a tube portion 23*e* formed to have a diameter smaller than the large diameter portion 23*c*. The tube portion 23*e* is fitted to an opening end portion on the main valve portion 21*c* side of the main valve element 21 so that the valve element 20 is formed. Thereby, the intermediate communication passage 29 passing through in the axial direction is formed in the inside of the main valve element 21 and the adapter 23, that is, the inside of the valve element 20. An auxiliary valve portion 23*d* is formed in the large diameter portion 23*c* of the adapter 23. The auxiliary valve portion 23*d* is brought into contact with and separated from an auxiliary valve seat 26*c* of the locking portion 26 of the rod 36 so as to open and close the intermediate communication passage 29 providing communication between the first communication passage 11 and the third communication passage 13. The auxiliary valve portion 23*d* and the auxiliary valve seat 26*c* form an auxiliary valve 27*c*. A situation where the auxiliary valve portion 23*d* and the auxiliary valve seat 26*c* are brought from a contact state into a separate state will be indicated as the auxiliary valve 27*c* is opened or the auxiliary valve portion 23*d* is opened. A situation where the auxiliary valve portion 23*d* and the auxiliary valve seat 26*c* are brought from a separate state into a contact state will be indicated as the auxiliary valve 27*c* is closed or the auxiliary valve portion 23*d* is closed.

Next, the solenoid 30 will be described. The solenoid includes the rod 36, a plunger case 38, an electromagnetic coil 31, the core 32 formed by a center post 32*a* and a base member 32*b*, a plunger 35, a plate 34, and a solenoid case 33. The plunger case 38 is a bottomed cylindrical hollow member whose one side is open. The plunger 35 is arranged movably in the axial direction with respect to the plunger case 38 between the plunger case 38 and the center post 32*a* arranged inside the plunger case 38. The core 32 is fitted to the valve main body 10 and arranged between the plunger 35 and the valve main body 10. The rod 36 is arranged to pass through the center post 32*a* of the core 32 and the valve element 20 arranged in the valve main body 10. The rod 36 has a gap from a through hole 32*e* of the center post 32*a* of the core 32 and the intermediate communication passage 29 of the valve element 20, and can be relatively moved with respect to the core 32 and the valve element 20. One end portion 36*e* of the rod 36 is connected to the plunger 35 and the locking portion 26 is connected to a pressing portion 36*h* serving as the other end portion.

The locking portion 26 serving as part of the rod 36 will be described. The locking portion 26 is a disc plate shaped member in which a base portion 26*a* is formed and brim portions are formed from the base portion 26*a* on both sides in the axial direction. One of the brim portions functions as the auxiliary valve seat 26*c* to be separated from and connected to the auxiliary valve portion 23*d* of the adapter 23, and the other brim portion functions as a pressing portion 26*d* to be separated from and connected to the flange portion 24*d* of the pressure-sensitive body 24 so as to extend and contract the pressure-sensitive body 24. A distribution hole 26*f* through which a coolant is distributed is formed in the base portion 26*a* of the locking portion 26. The locking portion 26 may be integrated with the rod 36 or the locking portion 26 may be fitted and fixed to the rod 36 and integrally formed.

A spring 37 (second biasing member according to the present invention) that biases the plunger 35 so as to separate the plunger from the core 32 is arranged between the core 32 and the plunger 35. Thereby, biasing force of the spring 37 acts in the direction in which the main valve portion 21*c* of the valve element 20 is opened.

An opening end portion of the plunger case 38 is fixed to an inner peripheral portion of the base member 32*b* of the core 32 in a sealed state, and the solenoid case 33 is fixed to an outer peripheral portion of the base member 32*b* in a sealed state. The electromagnetic coil 31 is arranged in a space surrounded by the plunger case 38, the base member 32*b* of the core 32, and the solenoid case 33 and not brought into contact with the coolant. Thus, it is possible to prevent a decrease in insulation resistance.

Figure 5:
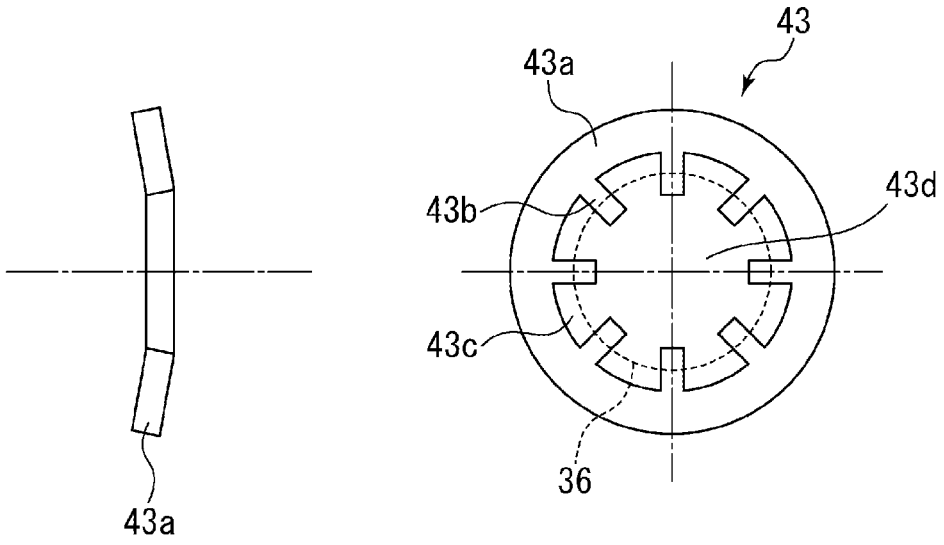
FIG. 5 is a view showing a first biasing member.
Figure 6:
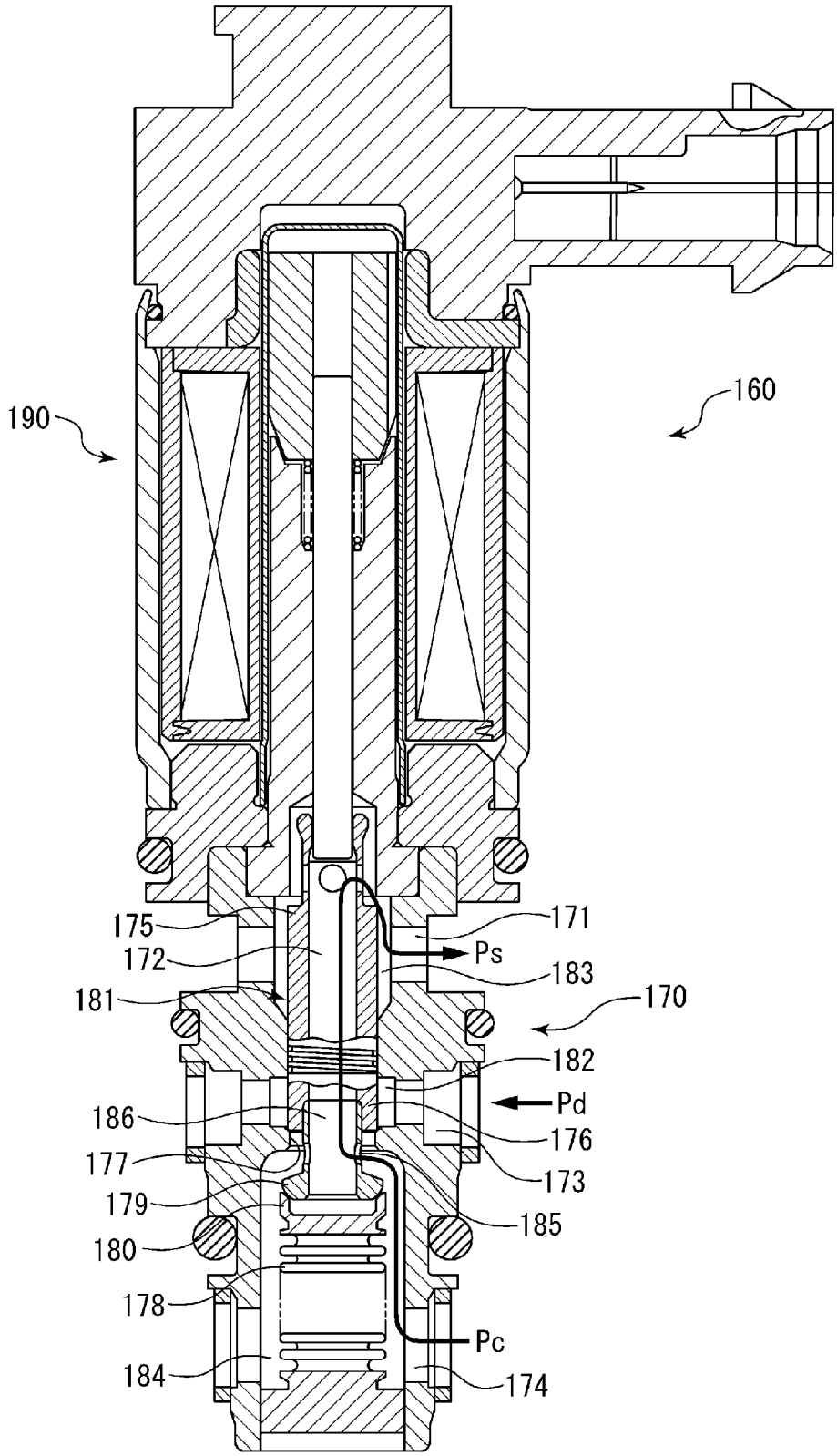
FIG. 6 Conventional Art
FIG. 6 is a front sectional view showing a conventional capacity control valve.
Figure 7:
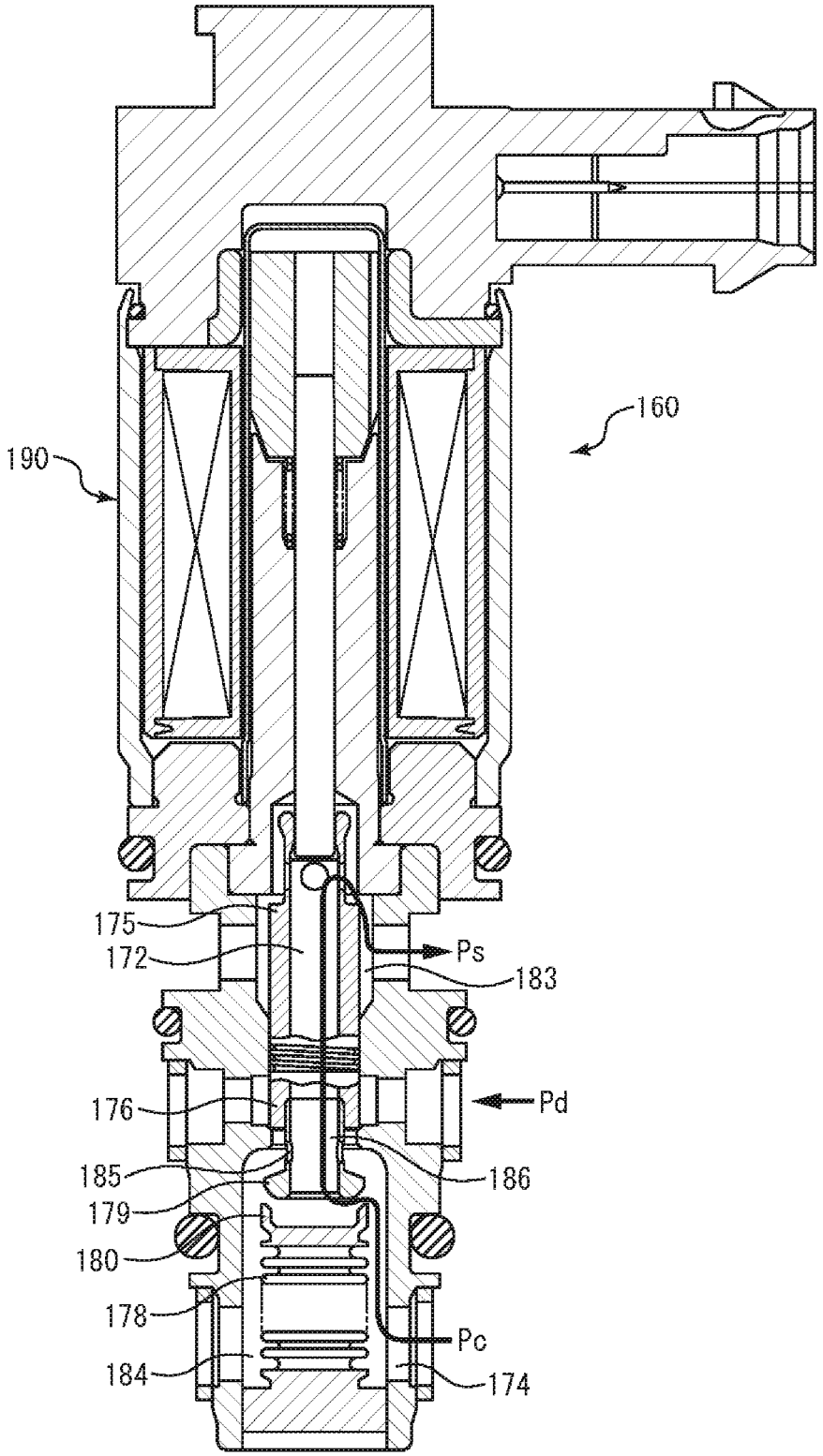
FIG. 7 Conventional Art
FIG. 7 shows a state of the conventional capacity control valve at the time of liquid coolant discharge.

Next, a disc spring 43 (first biasing member according to the present invention) will be described. As shown in FIG. 5, the disc spring 43 is a circular-conical disc plate having a hole 43*d* larger than an outer diameter of the rod 36 in a center portion. In the hole 43*d*, plural projected portions 43*b* extending toward the center of the disc spring 43 are formed. A part between the adjacent projected portions functions as a communication passage 43*c* through which the coolant flows. Even in a state where the disc spring 43 and the rod 36 are in contact with each other, the coolant flows through the communication passage 43*c*. is not inhibited.

The disc spring 43 is arranged between the solenoid 30 and the valve element 20. Specifically, one end of the disc spring 43 is in contact with a stepped portion 36*f* of the rod 36 formed at the substantially same position as the end portion 32*c* of the core 32, and the other end (i.e. an outer circumference 43*a* of the disc spring 43) is in contact with an inside stepped portion 21*h* formed on the intermediate communication passage 29 side of the valve element 20. The disc spring 43 has such a non-linear spring constant that the spring constant of the disc spring 43 is increased with a small applied load and the spring constant of the disc spring 43 is decreased with a large load.

Actions of the capacity control valve 1 having the configuration described above will be described. A flow passage running from the third communication passage 13 to the first communication passage 11 through the intermediate communication passage 29 will be called as the "Pc-Ps flow passage" below. A flow passage running from the second communication passage 12 to the third communication passage 13 through the valve hole 17 will be called as the "Pd-Pc flow passage" below.

First, movement of the rod 36 and movement of the valve portions of the valve element 20 will be described. First of all, in a non-energized state of the solenoid 30, as shown in FIGS. 1 and 2, the rod 36 is pushed upward by biasing force of the pressure-sensitive body 24 and the biasing force of the spring 37 (FIG. 1), the adapter 23 in contact with the locking portion 26 of the rod 36 is pressed upward so that the main valve portion 21*c* is fully opened, and the shut-off valve portion 21*a* is brought into contact with the end portion 32*c* of the core 32 so that the shut-off valve portion 21*a* is fully closed. In a non-energized state of the solenoid 30, a load acting on the disc spring 43 is almost zero, and a warp amount of the disc spring is also zero.

Figure 3:
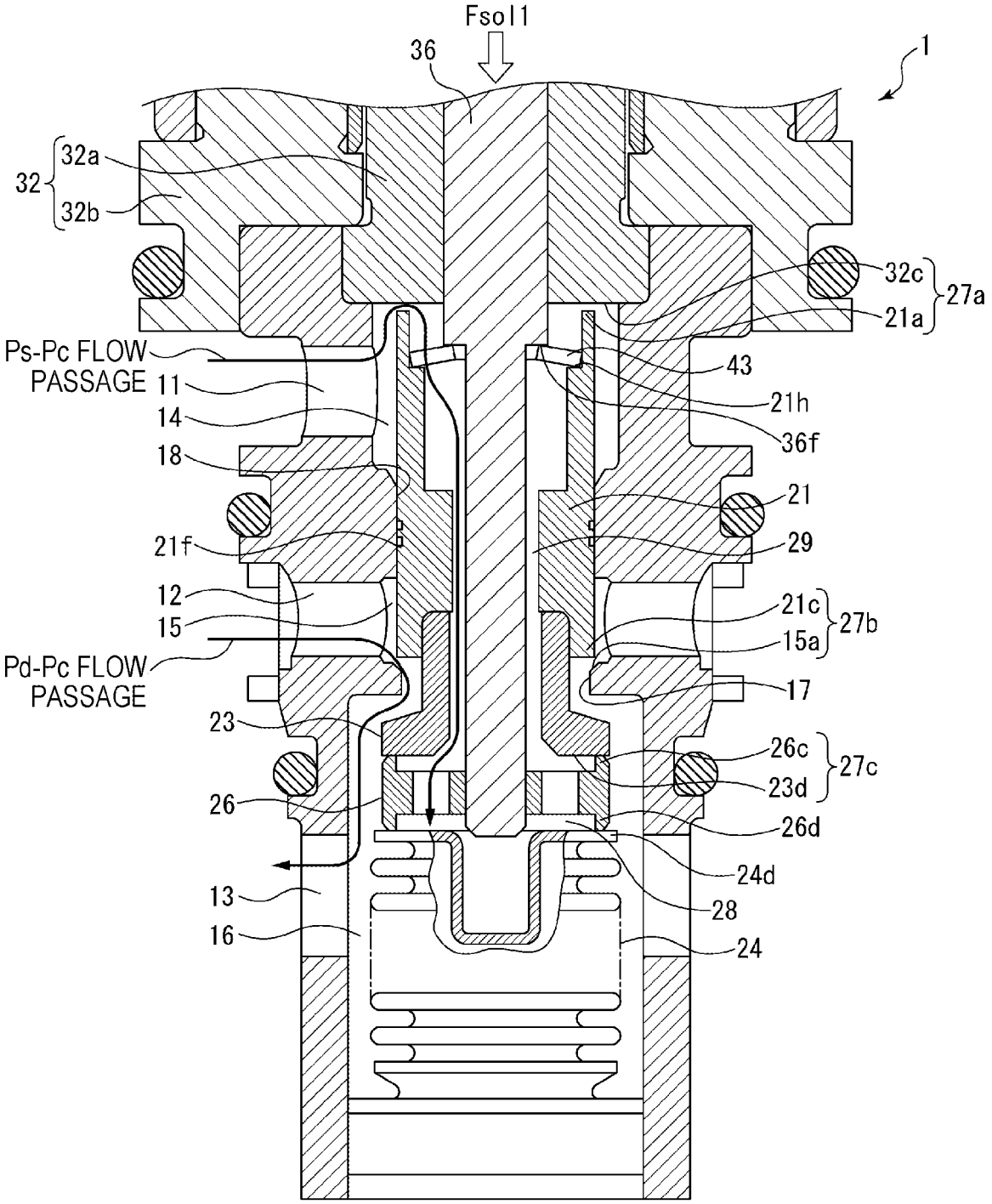
FIG. 3 is an enlarged view of part of the valve main body, the valve element, and the solenoid of FIG. 1 showing a control state of the capacity control valve.

Next, as shown in FIG. 3, when energization of the solenoid 30 is started from a non-energized state, the rod 36 is gradually driven in the forward direction (direction in which the rod 36 pops out from the end portion 32*c* of the core 32 to the outside). At this time, the valve element 20 is pressed to the lower side of FIG. 3 via the disc spring 43, and the pressure-sensitive body 24 is pressed by the locking portion 26 of the rod 36. Thereby, the shut-off valve portion 21*a* is separated from the end portion 32*c* of the core 32, the shut-off valve 27*a* is opened from a fully closed state, and the main valve 27*b* is gradually narrowed down from a fully opened state. In the opened state of the main valve 27*b*, the load acting on the disc spring 43 is small, and the spring constant of the disc spring 43 is large. Therefore, since the disc spring is hardly deformed, the rod 36 is not relatively displaced with respect to the valve element 20, and the valve element 20 and the rod 36 are integrally displaced. Thus, the capacity control valve 1 can stably control an opening degree of the main valve 27*b*.

Figure 4:
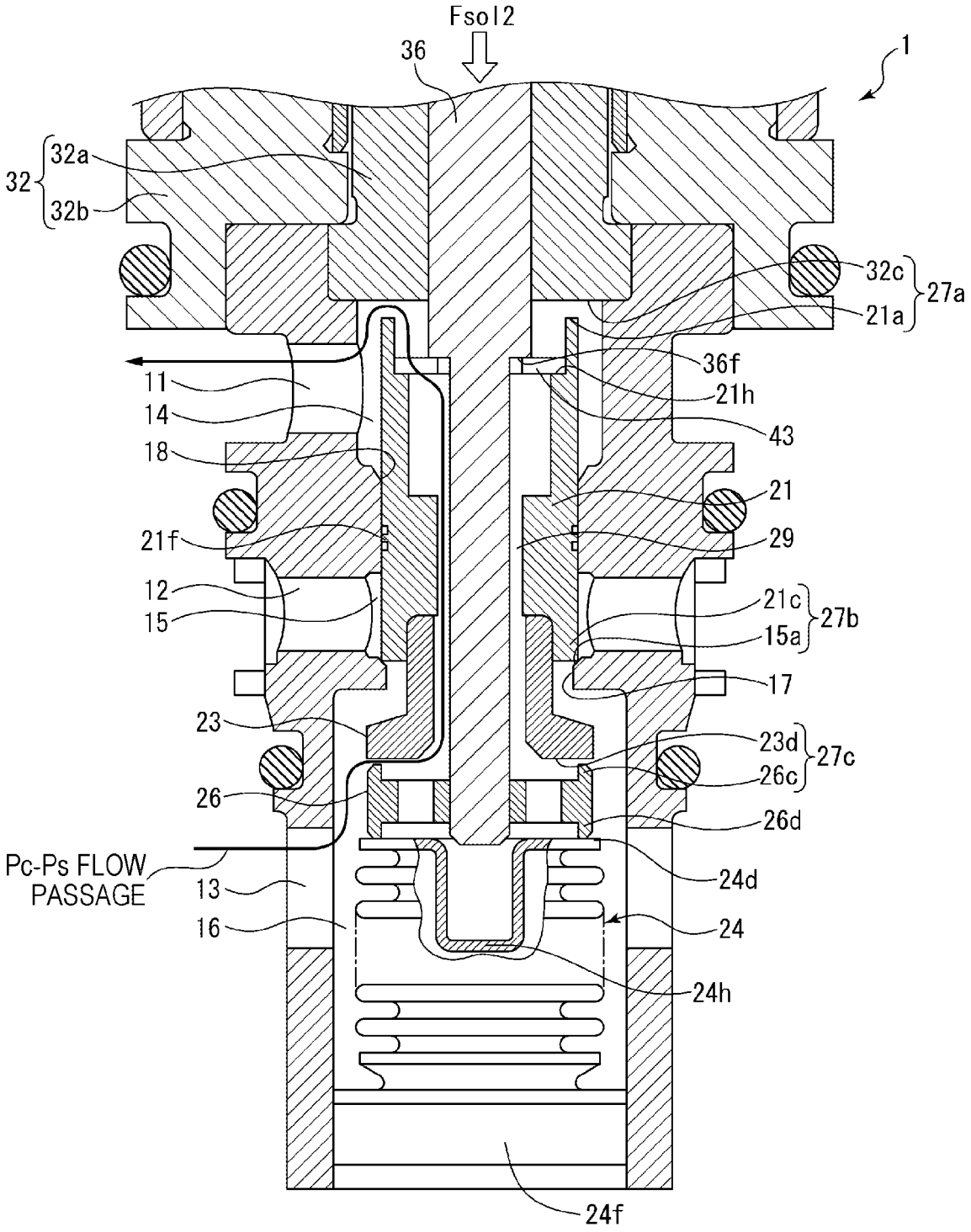
FIG. 4 is an enlarged view of part of the valve main body, the valve element, and the solenoid of FIG. 1 showing a state of the capacity control valve at the time of liquid coolant discharge.

Further, when the rod 36 is driven in the forward direction, as shown in FIG. 4, the shut-off valve 27*a* is brought into a fully opened state, the main valve portion 21*c* is brought into contact with the main valve seat 15*a*, the main valve 27*b* is brought into a fully closed state, and the movement of the valve element 20 is stopped. When the rod 36 is driven in the forward direction in a fully closed state of the main valve 27*b*, that is, in a state where the valve element 20 is stopped, a large load acts on the disc spring 43, and the spring constant of the disc spring 43 is lowered. Thereby, the solenoid 30 does not output drive force and the disc spring 43 can be deformed. Thus, the rod 36 is easily relatively moved with respect to the valve element 20 (the main valve element 21 and the adapter 23), and the auxiliary valve seat 26*c* of the locking portion 26 is separated from the auxiliary valve portion 23*d* of the adapter 23, so that it is possible to open the auxiliary valve 27*c*. Further, when the rod 36 is driven, the disc spring 43 is further displaced, the pressing portion 26*d* of the locking portion 26 presses the flange portion 24*d*, and the pressure-sensitive body 24 is contracted, so that it is possible to bring the auxiliary valve 27*c* into a fully opened state. When the pressure-sensitive body 24 is contracted by a predetermined amount, a projected portion 24*h* of the flange portion 24*d* and a projected portion (not shown) provided in the partition adjusting portion 24*f* are brought into contact with each other, deformation of the pressure-sensitive body 24 is stopped, and the movement of the rod 36 is also stopped.

Next, a control state of the capacity control valve 1 will be described based on FIG. 3. The control state is a state where the auxiliary valve 27*c* is in a closed state, the opening degree of the main valve 27*b* is set to an opening degree determined in advance, and pressure of the suction chamber of the variable capacity compressor is controlled to be a set value Pset. In this state, the fluid of the suction pressure Ps flowing from the suction chamber of the variable capacity compressor to the first valve chamber 14 through the first communication passage 11 passes through the intermediate communication passage 29, flows to an internal space 28 surrounded by the locking portion 26 of the rod 36 and the pressure-sensitive body 24, and acts on the pressure-sensitive body 24. As a result, the main valve portion 21*c* is stopped at a position where force in the valve closing direction by the disc spring 43, force in the valve opening direction of the spring 37, force by the solenoid 30, and force by the pressure-sensitive body 24 to be extended and contracted in accordance with the suction pressure Ps are balanced, and the pressure of the suction chamber of the variable capacity compressor is controlled to be the set value Pset. However, even when the opening degree of the main valve 27*b* is set to the opening degree determined in advance, there is sometimes a case where the pressure Ps of the suction chamber is varied with respect to the set value Pset due to disturbance, etc. For example, when the pressure Ps of the suction chamber is increased to be more than the set value Pset due to disturbance, etc., the pressure-sensitive body 24 is contracted and the opening degree of the main valve 27*b* is decreased. Thereby, since the Pd-Pc flow passage is narrowed down, a coolant amount of the discharge pressure Pd flowing in from the discharge chamber to the crank chamber is reduced and pressure of the crank chamber is lowered. As a result, a tilting angle of a swash plate of the compressor is increased, a discharge capacity of the compressor is increased, and discharge pressure is lowered. On the contrary, when the pressure Ps of the suction chamber is decreased to be lower than the set value Pset, the pressure-sensitive body 24 is extended and the opening degree of the main valve 27*b* is increased. Thereby, since the Pd-Pc flow passage is increased, the coolant amount of the discharge pressure Pd flowing in from the discharge chamber to the crank chamber is increased and the pressure of the crank chamber is increased. As a result, the tilting angle of the swash plate of the compressor is decreased, the discharge capacity of the compressor is reduced, and the discharge pressure is increased. In this way, by the capacity control valve 1, it is possible to control the pressure of the suction chamber of the variable capacity compressor to be the set value Pset.

Next, a liquid coolant discharge state of the capacity control valve 1 will be described based on FIG. 4. After the compressor is stopped for a long time, a liquid coolant (made by cooling and liquefying a coolant during abandonment) is accumulated in the crank chamber. Thus, in order to ensure predetermined discharge pressure and a predetermined discharge flow rate after start-up of the compressor, there is a need for discharging the liquid coolant as soon as possible. At the time of liquid coolant discharge, since pressure of the third valve chamber 16 communicating with the crank chamber and the pressure Ps of the suction chamber are high pressure, the pressure-sensitive body 24 is contracted, and by driving the solenoid 30 in the forward direction and pressing the pressure-sensitive body 24 by the locking portion 26 of the rod 36, the auxiliary valve 27*c* is forcibly brought into a fully opened state. Thereby, the auxiliary valve portion 23*d* is maintained in a fully opened state. Thus, an opening degree of the auxiliary valve portion 23*d* is not changed from start of the liquid coolant discharge to completion of the liquid coolant discharge, and it is possible to discharge the liquid coolant from the crank chamber to the suction chamber via the Pc-Ps flow passage for a short time.

Conventionally, at the time of a liquid coolant discharging operation, focus is placed only on how quickly discharge of the liquid coolant is completed. Thus, there is sometimes a case where an engine load becomes excessive during the liquid coolant discharging operation. With the capacity control valve 1 according to the present invention, even at the time of the liquid coolant discharge, it is possible to rapidly drive the valve element 20. At the time of the liquid coolant discharge, actions of the capacity control valve 1 when the engine load is reduced will be described.

In a case where the engine load is rapidly reduced at the time of the liquid coolant discharge, the solenoid 30 is turned off and magnetic attracting force Fsol between the core 32 and the plunger 35 is operated to be zero. Since settings is made to cancel upward pressure and downward pressure acting on the valve element 20, regarding major force acting on the valve element 20 at the time of the liquid coolant discharge, the biasing force of the spring 37 acting in the valve opening direction of the main valve 27*b*, and the total force of the biasing force of the disc spring 43 acting in the valve closing direction of the main valve 27*b* and the magnetic attracting force Fsol of the solenoid 30 are balanced. When the magnetic attracting force Fsol of the solenoid 30 becomes zero, the biasing force of the spring 37 acting in the valve opening direction of the main valve 27*b* becomes dominant, the rod 36 is moved upward, and the disc spring 43 is returned to the natural state. As a result, the rod 36 is rapidly pushed up, the locking portion 26 is brought into contact with the adapter 23, the valve element 20 is driven in the valve opening direction of the main valve 27*b*, and the main valve 27*b* is rapidly fully opened. When the main valve 27*b* is fully opened, a coolant amount flowing from the discharge chamber of the compressor to the crank chamber through the Pd-Pc flow passage is increased, the pressure Pc in the crank chamber is increased, and the compressor is operated by the minimum capacity. In this way, as the time of the liquid coolant discharge, even in a state where the auxiliary valve 27*c* is in an opened state and no force acts on the valve element 20 from the pressure-sensitive body 24, it is possible to reduce the load of the compressor and hence it is possible to reduce the engine load even at the time of the liquid coolant discharge.

In a state where the pressure of the suction chamber of the compressor is controlled to be the set value Pset by the capacity control valve 1, and in a case where the load of the engine is to be reduced, by bringing the solenoid 30 into a non-energized state similarly to the above description, the main valve 27*b* is brought into a fully opened state, the coolant amount of the Pd pressure flowing from the discharge chamber of the compressor to the crank chamber through the Pd-Pc flow passage is increased, and the compressor is operated by the minimum capacity, so that it is possible to perform an operation with which the load of the engine is reduced.

The disc spring 43 has such a non-linear characteristic that the spring constant is increased with a small load and the spring constant is decreased with a large load. Thereby, in the opened state of the main valve 27*b* where the load acting on the disc spring 43 is small, the spring constant is increased, and hence the disc spring 43 is hardly deformed. Therefore, the rod 36 and the valve element 20 are integrally displaced in a state where relative positions are maintained. Thus, the capacity control valve 1 can stably control the opening degree of the main valve 27*b*. In the closed state of the main valve 27*b* where the load acting on the disc spring 43 is large, the spring constant of the disc spring 43 is decreased. Thus, without excessively increasing an output of the solenoid 30, the rod 36 can largely deform the disc spring 43 and forcibly open the auxiliary valve 27*c*. Thereby, at the time of the liquid coolant discharge, it is possible to maintain the auxiliary valve 27*c* in a fully opened state irrespective of the pressure of the third valve chamber 16 and the pressure Ps of the suction chamber. Thus, it is possible to discharge the liquid coolant from the crank chamber to the suction chamber via the Pc-Ps flow passage for a short time.

The embodiment of the present invention is described with the drawings above. Specific configurations are not limited to the embodiment but the present invention also includes changes and additions within the range not departing from the gist of the present invention.

For example, in the above embodiment, the one end of the disc spring 43 is in contact with the stepped portion 36*f* of the rod 36, and the other end is in contact with the inside stepped portion 21*h* of the valve element 20. However, the present invention is not limited to this. For example, as shown in FIG. 5, one end of a spring 44 may be in contact with the end portion 32*c* of the core 32 and the other end may be in contact with the inside stepped portion 21*h* of the valve element 20.

In the above embodiment, the first pressure of the first valve chamber 14 is the suction pressure Ps of the variable capacity compressor, the second pressure of the second valve chamber 15 is the discharge pressure Pd of the variable capacity compressor, and the third pressure of the third valve chamber 16 is the pressure Pc of the crank chamber of the variable capacity compressor. However, the present invention is not limited to this but with the first pressure of the first valve chamber 14 being the pressure Pc of the crank chamber of the variable capacity compressor, the second pressure of the second valve chamber 15 being the discharge pressure Pd of the variable capacity compressor, and the third pressure of the third valve chamber 16 being the suction pressure Ps of the variable capacity compressor, it is possible to respond to various variable capacity compressors.

REFERENCE SIGNS LIST

1 capacity control valve
10 valve main body
11 first communication passage
12 second communication passage
13 third communication passage
14 first valve chamber
15 second valve chamber
15*a* main valve seat
16 third valve chamber
17 valve hole
20 valve element
21 main valve element
21*a* shut-off valve portion

21*c* main valve portion
23 adaptor
23*d* auxiliary valve portion
24 pressure-sensitive body
24*a* bellows
24*d* flange portion
26 locking portion
26*c* auxiliary valve seat
26*d* pressing portion
27*a* shut-off valve
27*b* main valve
27*c* auxiliary valve
29 intermediate communication passage
30 solenoid portion
31 electromagnetic coil
32 core
35 plunger
36 rod
37 spring (second biasing member)
43 disc spring (first biasing member)
Fsol magnetic attracting force
Ps suction pressure (first pressure) (third pressure)
Pd discharge pressure
Pc control chamber pressure (third pressure) (first pressure)
Pset suction pressure set value

The invention claimed is:

1. A capacity control valve that controls a flow pressure of a variable capacity compressor accordance with a valve opening degree of a valve portion, the capacity control valve being characterized by comprising:

(i) a valve main body having:

a first communication passage through which a fluid of suction pressure of the variable capacity compressor passes, a first valve chamber communicating with the first communication passage, a second communication passage which is arranged adjacent to the first communication passage and through which a fluid of discharge pressure of the variable capacity compressor passes, a second valve chamber communicating with the second communication passage, a third communication passage through which a fluid of pressure of a crank chamber of the variable capacity compressor passes, a third valve chamber communicating with the third communication passage, and a main valve seat arranged in a valve hole which provides communication between the second communication passage and the third communication passage;

a pressure-sensitive body arranged in the third valve chamber and extending or contracting an accordance with surrounding pressure;

(ii) a solenoid having:

an electromagnetic coil, a plunger, a core arranged between the plunger and the valve main body, a rod to which the plunger is connected to one end and an auxiliary valve seat arranged in the third valve chamber is connected to the other end, and a second biasing member arranged between the plunger and the core;

(iii) a valve element having:

a main valve element with an intermediate communication passage providing communication between the first communication passage and the third communication passage, a shut-off valve portion arranged in the first valve chamber, a main valve portion arranged in the second valve chamber, and an auxiliary valve portion arranged in the third valve chamber, and iv) a first biasing member that biases in a valve closing direction of the main valve portion, wherein the shut-off valve portion alternatively opens and closes communication between the intermediate communication passage and the first valve chamber by detaching and touching the core of the solenoid, respectively, the main valve portion alternatively opens and closes the valve hole by detaching and touching the main valve seat, respectively, the auxiliary valve portion alternatively opens and closes the intermediate communication passage by detaching and touching the auxiliary valve seat, respectively, the first biasing, member is a disc spring which is a circular-conical disc plate having a hole in a center portion, and a spring constant of the disc spring has a characteristic that the spring constant is increased in an opened state of the main valve portion and decreased in a closed state, such that in the opened state of the main valve portion, the main valve element and the rod are integrally displaced and relative positions of the main valve element and the rod are maintained, and the rod is displaced relative to the main valve element by a deformation of the disc spring which is located radially between the rod and the main valve element to open the auxiliary valve portion.

2. The capacity control valve according to claim 1, wherein the disc spring is arranged between the rod and the valve element, the disc spring has plural projected portions each extending toward the center portion of the disc spring from the hole, an outer circumference of the disc spring is in contact with a stepped portion provided on an inner side of the valve element, and the projected portions are in contact with a stepped portion provided in the rod.

3. The capacity control valve according to claim 2, wherein a space between adjacent ones of the plural projected portions of the disc spring functions as a communication passage communicating with the intermediate communication passage.

4. A capacity control valve that controls a flow rate or pressure of a variable capacity compressor in accordance with a valve opening degree of a valve portion, the capacity control valve being characterized by comprising:

(i) a valve main body having:

a first communication passage through which a fluid of suction pressure of the variable capacity compressor passes, a first valve chamber communicating with the first communication passage, a second communication passage which is arranged adjacent to the first communication passage and through which a fluid of discharge pressure of the variable capacity compressor passes, a second valve chamber communicating with the second communication passage, a third communication passage through which a fluid pressure a crank chamber of the variable capacity compressor passes, a third valve chamber communicating with the third communication passage, and a main valve seat arranged in a valve hole which provides communication between the second communication passage and the third communication passage;

a pressure-sensitive body arranged in the third valve chamber and extending or contracting in accordance with surrounding pressure;

(ii) a solenoid having:

an electromagnetic coil, a plunger, a core arranged between the plunger and the valve main body, a rod to which the plunger is connected to one end and an auxiliary valve seat arranged in the third valve chamber is connected to the other end, and a second biasing member arranged between the plunger and the core;

(iii) a valve element having:

a main valve element with an intermediate communication passage providing communication between the first communication passage and the third communication passage, a shut-off valve portion arranged in the first valve chamber, a main valve portion arranged in the second valve chamber, and an auxiliary valve portion arranged in the third valve chamber, and (iv) a first biasing member that biases in a valve closing direction of the main valve portion, wherein the shut-off valve portion alternatively opens and closes communication between the intermediate communication passage and the first valve chamber by detaching and touching the core of the solenoid, respectively, the main valve portion alternatively opens and closes the valve hole by detaching and touching the main valve seat, respectively, the auxiliary valve portion alternatively opens and closes the intermediate communication passage by detaching and touching the auxiliary valve seat, respectively, the first biasing member is a disc spring which is a circular-conical disc plate having a hole in a center portion, and a spring constant of the disc spring has a characteristic that the spring constant is increased in an opened state of the main valve portion and decreased in a closed state, and wherein the disc spring is arranged between the rod and the valve element, the disc spring has plural projected portions each extending toward the center portion of the disc spring from the hole, an outer circumference of the disc spring is in contact with a stepped portion provided on an inner side of the valve element, and the projected portions are in contact with a stepped portion provided in the rod.

5. The capacity control valve according to claim 4, wherein a space between adjacent ones of the plural projected portions of the disc spring functions as a communication passage communicating with the intermediate communication passage.

* * * * *